United States Patent [19]

Ericsson et al.

[11] Patent Number: 4,907,505

[45] Date of Patent: Mar. 13, 1990

[54] STENCIL FRAME SECURING AND REGISTERING APPARATUS

[76] Inventors: Sylve J. D. Ericsson, Tolléns väg 8, 147 00 Tumba; Nils A. E. Lindström, Vårstigen 11, 144 00 Rönninge, both of Sweden

[21] Appl. No.: 251,069

[22] Filed: Sep. 27, 1988

Related U.S. Application Data

[63] Continuation of Ser. No. 639,517, Aug. 8, 1984, abandoned, which is a continuation of Ser. No. 491,038, May 3, 1983, abandoned.

[30] Foreign Application Priority Data

May 5, 1982 [SE] Sweden ..... 82028168

[51] Int. Cl.[4] ..... B41F 15/08

[52] U.S. Cl. ..... 101/114; 101/DIG. 36

[58] Field of Search ..... 101/126, 127.1, 115, 101/114, DIG. 36

[56] References Cited

U.S. PATENT DOCUMENTS

| | | | |
|---|---|---|---|
| 707,961 | 8/1902 | Elliott | 101/127.1 |
| 791,450 | 6/1905 | Bardick | 101/114 |
| 836,483 | 11/1906 | Burdick | 101/123 |
| 2,013,089 | 9/1935 | Elliott | 101/124 |
| 2,206,176 | 7/1940 | Foard | 101/126 |
| 2,369,602 | 2/1945 | Petty | 101/114 |
| 2,462,447 | 2/1949 | Wellborn | 101/123 |
| 2,609,747 | 9/1952 | Schwartz | 101/115 |
| 2,684,104 | 7/1954 | Dessart et al. | 101/123 |
| 2,690,118 | 9/1954 | Schwartz | 101/123 |
| 2,943,565 | 7/1960 | Malek | 101/127.1 |
| 2,991,711 | 7/1961 | Ehrhard | 101/126 |
| 3,001,786 | 9/1961 | Carrozza | 101/126 |
| 3,180,253 | 4/1965 | Hildmann | 101/316 |
| 3,215,071 | 11/1965 | Stillwell | 101/126 |
| 3,505,951 | 4/1970 | Gartrell | 101/123 |
| 3,513,775 | 5/1970 | Guthrie | 101/114 |
| 3,536,004 | 10/1970 | Derrickson | 101/123 |
| 3,537,406 | 11/1970 | Ort | 101/129 |
| 3,577,914 | 5/1971 | Ronge | 101/124 |
| 3,812,779 | 5/1974 | Cobb | 101/193 |
| 3,943,849 | 3/1976 | Vasilantone | 101/123 |
| 4,003,476 | 1/1977 | Laskey | 101/114 |
| 4,058,307 | 11/1977 | Bubley | 101/123 |
| 4,094,242 | 6/1978 | Ichinose | 101/123 |
| 4,193,344 | 3/1980 | Ericsson | 101/129 |
| 4,254,707 | 3/1981 | Lambert et al. | 101/129 |
| 4,267,773 | 5/1981 | Scherp et al. | 101/127.1 |
| 4,404,903 | 9/1983 | Cronin | 101/123 |
| 4,462,174 | 7/1984 | Messerschmidt | 101/127.1 |
| 4,589,335 | 5/1986 | Svantesson | 101/114 |
| 4,589,336 | 5/1986 | Klemm | 101/123 |
| 4,648,317 | 3/1987 | Bubley et al. | 101/123 |
| 4,668,329 | 5/1987 | Shirataki | 118/413 |

FOREIGN PATENT DOCUMENTS

| | | | |
|---|---|---|---|
| 197803 | 3/1978 | Fed. Rep. of Germany | 101/123 |
| 2743234 | 3/1978 | Fed. Rep. of Germany | 101/127.1 |
| 3220489 | 12/1983 | Fed. Rep. of Germany | 101/123 |
| 93552 | 7/1981 | Japan | 101/126 |
| 257432 | 1/1971 | U.S.S.R. | 101/127.1 |
| 515661 | 9/1976 | U.S.S.R. | 101/123 |
| 631363 | 11/1978 | U.S.S.R. | 101/114 |
| 765022 | 9/1980 | U.S.S.R. | 101/123 |
| 802091 | 2/1981 | U.S.S.R. | 101/114 |
| 754220 | 8/1956 | United Kingdom | 101/123 |
| 912806 | 12/1962 | United Kingdom | 101/123 |
| 2028721 | 3/1980 | United Kingdom | 101/123 |

*Primary Examiner*—Clifford D. Crowder

*Attorney, Agent, or Firm*—Burns, Doane, Swecker & Mathis

[57] ABSTRACT

A device for securing and/or registering the stencil frame for a screen printing machine, said screen printing machine having amongst other things a printing table and a scraper and/or ink application device arranged above the printing table. Between the printing table and the scraper arrangement are arranged one or more guides (6, 7) intended to interact with the stencil frame (5). These guides are designed in such a way that the stencil frame (5) is able to be moved or displaced as a single unit from an initial position outside the screen printing machine to an appropriate position inside the screen printing machine, and vice versa. Inside the screen printing machine are present registering devices (8, 9) intended to guide the stencil frame into a registration position. The elements intended to interact with the stencil frame comprise at least two guides (6, 7) running parallel to each other, along which the stencil frame (5) is capable of being displaced. In addition means (8, 9) are provided for forcing the stencil frame against one of the guides (7) before registration.

2 Claims, 2 Drawing Sheets

STENCIL FRAME SECURING AND REGISTERING APPARATUS

This application is a continuation of application Ser. No. 639,517, filed Aug. 8, 1984, which was a continuation of application Ser. No. 491,038, filed May 3, 1983, both now abandoned.

TECHNICAL FIELD

The present invention relates to a device for securing and/or registering the stencil frame for a screen printing machine intended to be used in conjunction with a screen printing machine of the kind which has amongst other things a printing table and a scraper and/or ink application device arranged above the printing table.

DESCRIPTION OF THE PRIOR ART

Previously disclosed is the use by screen printing machines of the nature described above of a stencil frame in which a stencil is secured. The stencil frame is usually in the form of an aluminium section, and the stencil may be attached to the stencil frame by various means.

In screen printing machines of the nature described above, it is usual to move the scraper arrangement and/or ink application device to one of its end positions and in so doing to expose the stencil frame, which may then be released, lifted up and removed, whereupon a new stencil frame with the stencil securely attached may be placed in the position previously occupied by the earlier stencil frame.

Furthermore, conventional stencil frames are relatively heavy, and accordingly considerable effort is required for the purpose of exchanging stencil frames.

DESCRIPTION OF THE PRESENT INVENTION

Technical Problem

It has been found to be a major technical problem to design a device enabling the replacement in a simple fashion of a stencil frame complete with its associated stencil situated inside a screen printing machine by another stencil frame fitted with its stencil..

Not only is the work involved in replacing one stencil frame by another heavy and troublesome, but the procedure is also extremely time-consuming.

The aforementioned work is particularly troublesome, of course, in relation to a screen printing machine which for various reasons is used to take only a limited number of impressions from each of the stencils with their associated stencil frames which are introduced one after the other into the screen printing machine. It is not unusual in such applications for the time involved in lifting out and dropping in the stencil frames when exchanging the stencil frames to be considerably greater than the time involved in the actual printing.

The work involved in dropping in and lifting out the stencil frames usually also calls for a great deal of physical exertion.

A major technical problem is thus encountered in relation to a screen printing machine of the nature described above in creating conditions such that the replacement of the stencil frame can take place not only in a straightforward fashion, but also without wasting a great deal of time, and also with very little physical effort being required on the part of the operator.

SOLUTION

The present invention now proposes a device for securing and/or registering the stencil frame for a screen printing machine, said screen printing machine having amongst other things a printing table and a scraper device and/or ink application device arranged above the printing table.

The characteristic features of the present invention are that between the printing table and the scraper device are arranged one or more guides intended to interact with the stencil frame, that these guides are designed in such a way that the stencil frame is able to be moved or displaced as a single unit from an initial position outside the screen printing machine to an appropriate position inside the screen printing machine and vice versa, and that inside the screen printing machine are present registering organs intended to guide the stencil frame into a registration position. The registration surface may be formed on or alongside the guides intended to interact with the stencil frame.

The present invention specifically proposes that the organs intended to interact with the stencil frame should be in the form of at least two guides running parallel to each other and along which the stencil frame is capable of being displaced, and that in addition means should be provided for forcing the stencil frame against the perpendicular guide before registration.

The present invention also proposes that a number of cylinder and piston devices forcing the stencil frame against the guides intended to interact with the stencil frame should be capable of being activated after registration of the stencil frame. The clamping cylinder and piston devices are so arranged as to operate at right-angles (vertically) to the direction of operation of the registering organs.

The present invention also proposes a special means enabling the stencil frame to be forced before registration against the perpendicular guide by designing this means as an articulated arrangement so arranged that a contact surface on the registering organ intended to interact with the frame can be brought into contact with that part of the frame which faces away from the direction of displacement when the stencil frame is moved into the screen printing machine.

The present invention also proposes that the stencil frame shall be capable of being placed in a special feeding and/or discharging arrangement capable of being turned from an appropriate inclined position adjacent to the screen printing machine to a horizontal position, from which horizontal position the stencil frame is so arranged as to be capable of being fed into and withdrawn from guides included in the screen printing machine and intended to interact with the stencil frame. The feeding and/or discharging arrangement is capable of being turned manually between the positions indicated.

The idea of invention naturally also includes the possibility of causing the stencil frame to be capable of being placed in a special feeding and/or discharging arrangement, said arrangement being intended to provide the automatic replacement of one stencil frame by another.

ADVANTAGES

The principal advantages which may be regarded as being associated with a device for securing and/or registering the stencil frame for a screen printing machine are that in this way suitable conditions are created for the replacement of one stencil frame complete with its stencil by another stencil frame complete with its stencil in a straightforward fashion wasting little time and requiring little physical effort on the part of the operator.

BRIEF DESCRIPTION OF THE DRAWINGS

A preferred embodiment exhibiting the significant characteristics of the present invention is described below with reference to the attached drawings, in which.

DESCRIPTION OF THE PREFERRED EMBODIMENT

Figure 1:
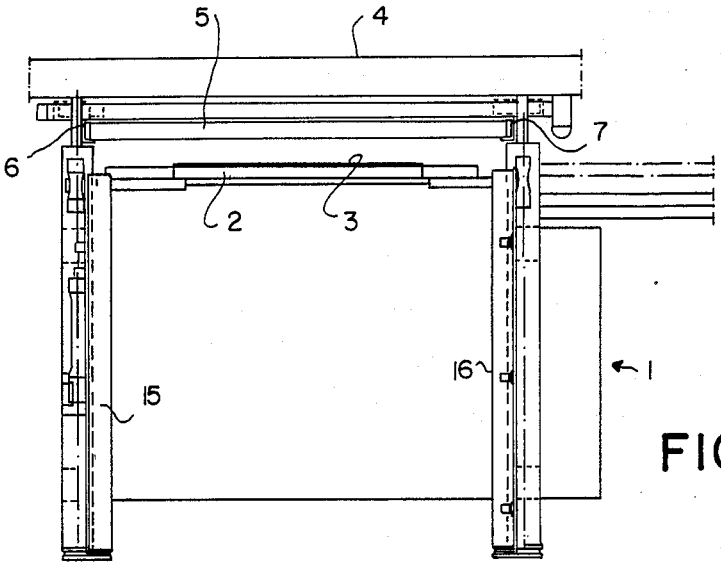
FIG. 1 shows a screen printing machine complete with a device for securing and/or registering the stencil frame.

FIG. 1 thus shows a side view of a screen printing machine 1 equipped with a device in accordance with the present invention for securing and/or registering a stencil frame. The screen printing machine exhibits amongst other things a printing table 2, on which has been placed a sheet of material 3 to be printed, and a scraper and/or ink application device 4 arranged above the printing table. The latter are not shown in detail, however, for purposes of clarity.

The present invention proposes that between the printing table 2 and the scraper arrangement 4 shall be arranged one or more guides 6, 7 intended to interact with a horizontal stencil frame 5. These guides 6, 7 are so designed that the stencil frame 5 is able to be moved horizontally as a single unit from an initial position outside the screen printing machine to an appropriate position inside the screen printing machine, and vice versa. For this purpose the guides 6 and 7 are shown fully open in the view illustrated in FIG. 1.

Figure 2:
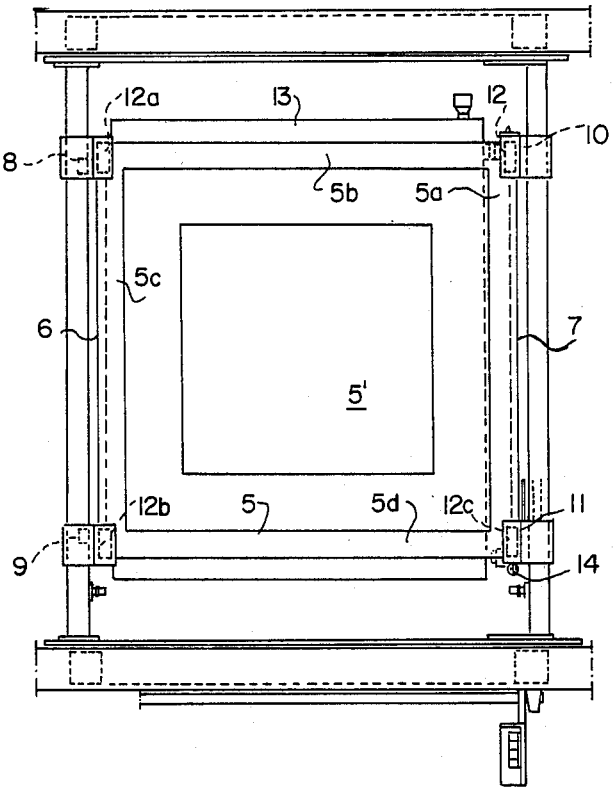
FIG. 2 shows a horizontal view of the arrangement in accordance with FIG. 1.

FIG. 2 shows that inside the screen printing machine are present registering means 8, 9 intended to guide by means of movement the stencil frame 5 complete with its stencil 5' into contact with the registration surfaces 10, 11 formed on the guide 7 intended to interact with the stencil frame.

The registering means 8, 9 are so arranged as to interact with the corners of the stencil frame 5.

The registering means 8, 9 may best each be formed from its own hydraulic or pneumatic piston arrangement, whereby the free end of the piston pushes the stencil frame 5 to the right, as shown in FIG. 2.

This will then cause the part 5*a* of the stencil frame 5 to be forced into contact with specially formed registration surfaces at the same time as the part 5*a* rests against the guide 7.

Also present is a guide 13 between the guides 6, 7 and running perpendicular to the guides, and also present are means of forcing the stencil frame against the perpendicular guide 13 before registration. These means have been given the reference designation 14 and are shown in greater detail in FIG. 5.

Figure 4:
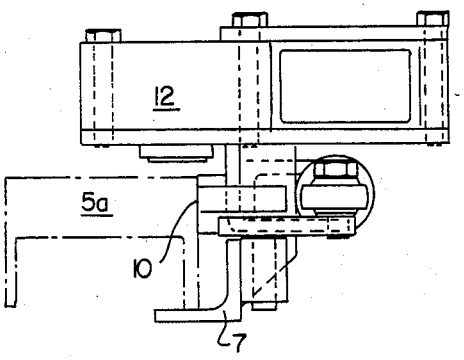
FIG. 4 shows a section through the screen printing machine for the purpose of illustrating an organ for clamping the stencil frame.

Particular reference may be made to FIG. 4, which shows that a cylinder and piston device 12 pressing hard against the part 5*a* of a stencil frame and against the guide 7, intended to interact with the stencil frame, is capable of being activated, after registration of the stencil frame, thereby causing the stencil frame 5*a* to be forced into strong contact with the guide 7. It is suggested that advantage may be derived by arranging for cylinder and piston devices of the kind shown in FIG. 4 to be present at each of the corners of the stencil frame, and accordingly these devices have been given the reference designations 12*a*, 12*b* and 12*c*.

It may also be appreciated from FIG. 4 that the clamped devices 12 may be in the form of a cylinder and piston arrangement wherein the stroke of which is arranged to operate at right-angles (vertically) to the operating plane of the registering guides 8, 9, 14.

Figure 3:
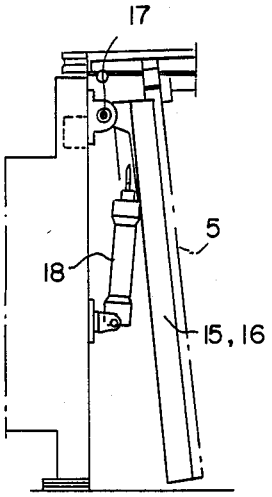
FIG. 3 shows a side view of part of the arrangement in accordance with FIG. 1.
Figure 5:
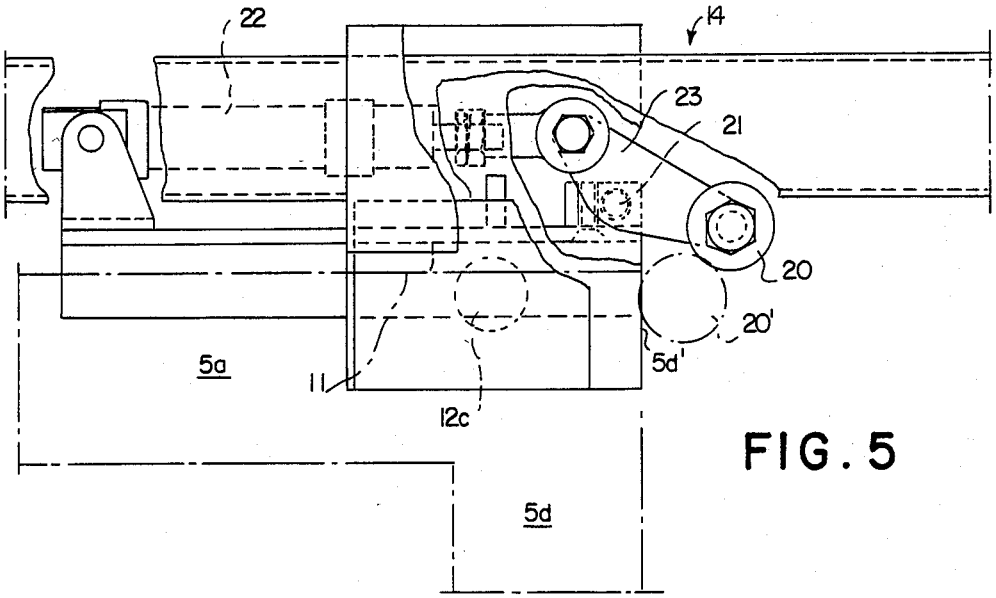
FIG. 5 shows a horizontal view of the means enabling the stencil frame to be forced against a perpendicular guide for the purpose of registration.

FIG. 3 shows that a stencil frame 5 may be placed outside the screen printing machine on two parallel guides 15, 16, whereupon the guides 15, 16 may be raised by means of a pivot shaft 17 into a horizontal position, whereupon the stencil frame 5 may be introduced into a horizontal position between the devices 6 and 7. Similarly, a stencil frame already inside the screen printing machine 1 may be moved from its registration position horizontally outwards along the guides 15 and 16, which may then be lowered enabling the frame 5 to be removed in a simple fashion. The pivoting of the guides 15, 16 is facilitated with the help of a hydraulic or pneumatic piston arrangement 18. FIG. 5 shows a means 14 intended before registration takes place to force the stencil frame 5 and in particular its constituent part 5*b* into the registration position. For the purpose of forcing the constituent part 5*b* of the stencil frame 5 against the perpendicular guide 13, an articulated lever arrangement 23 is provided which is so arranged that a contact surface 20 provided at one end of lever 23 in the position illustrated, assume a position alongside the constituent part 5*a* of the frame 5, although it may be turned by means of the articulated lever arrangement to the position 20' indicated by the dotted line, causing it to interact with a constituent part 5*d*' of the part of the frame 5*d*, said constituent part 5*d*' facing away from the direction of displacement when the stencil frame 5 is to be moved horizontally into the screen printing machine. The contact surface 20 is so arranged as to be capable of pivoting about a pivot shaft 21, and with the help of a piston arrangement 22 the articulation lever 23 may be imparted with a pivoting movement so that the surface will be moved either into the position indicated by a solid line or into the position indicated by a dotted line.

It will be appreciated from the above description that the stencil frame 5 may be placed in a special feeding and/or discharging arrangement incorporating the guides 15 and 16, said guides 15 and 16 being able to pivot about a shaft 17 between an initial position outside the screen printing machine, as shown in FIG. 3, and another (not shown) appropriate horizontal and/or initial position, from which latter position the stencil frame 5 is capable of being moved as a single unit horizontally into and out of the screen printing machine with the help of elements forming part of the screen printing machine and intended to interact with the stencil frame. The preferred embodiment illustrates that the feeding and/or discharging arrangement is capable of being turned manually between the indicated positions about a pivot shaft.

However, there is nothing to prevent the stencil frame 5 from being capable of being placed in a special feeding and/or discharging arrangement intended to provide the automatic replacement of one stencil frame by another.

Although the preferred embodiment describes in detail the registration of the stencil frame with the help of the registering means 8, 9, the registration surfaces 10, 11, the registering guide 14 and the securing or clamping cylinder and piston devices 12, 12*a*, 12*b* and 12*c*, it should also be borne in mind that registration could also take place by causing registration pins to drop down so as to interact with holes with or without sleeves formed in the frame, or that registration may take place simply with the help of clamping cylinder and piston devices 12 applied after the stencil frame has been positioned correctly.

The expression "to guide the stencil frame into a registration position" shall be understood to denote any procedure which will cause the stencil frame to adopt the registration position. This expression includes locking in position and/or displacement.

The invention is not, of course, restricted to the embodiment indicated above by way of example, but may undergo modifications within the context of the following Patent Claims.

The expression scraper means doctor blade or squeegee.

We claim:

1. A device for securing and registering a stencil frame with a printing machine which screen prints on material, said screen printing machine provided with a printing table and a scraper including an ink application device positioned above the printing table, positioned between the printing table and the scraper device one or more guides are provided so as to interact with the stencil frame so that the stencil frame is displaceable horizontally as a single unit to a printing position inside the screen printing machine and to a non-printing position outside the screen printing machine, registering means positioned inside the screen printing machine for guiding the stencil frame into a registration position, the guides interacting with the stencil frame being at least two guides running parallel to each other, along which the stencil frame is capable of being displaced, said registering means are provided for forcing the stencil frame against one of the guides for registration, a further guide extending between the guides and perpendicular to them, and means for forcing the stencil frame against the further guide for registration, wherein the displacement of the stencil frame is in a direction perpendicular to the direction of transport of the material via said guides positioned transversely across the machine, a number of cylinder and piston devices provided for forcing the stencil frame against the guides interacting with the stencil frame, said cylinder and piston devices capable of being activated after registration of the stencil frame, said guides positioned to cooperate with stencil feeding and discharge means adjacent said printing machine.

2. A device in accordance with claim 1, wherein the cylinder and piston devices are arranged to operate at right-angles to the registering means.

* * * * *